US010752270B2

(12) United States Patent
Driemel et al.

(10) Patent No.: US 10,752,270 B2
(45) Date of Patent: Aug. 25, 2020

(54) METHOD AND DEVICE FOR ASCERTAINING A MOVEMENT AUTHORITY FOR A TRACK-BOUND VEHICLE

(71) Applicant: SIEMENS MOBILITY GMBH, Munich (DE)

(72) Inventors: Andreas Driemel, Koenigslutter (DE); Jan Norden, Braunschweig (DE); Karsten Rahn, Cremlingen (DE); Patrik Zuralski, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 306 days.

(21) Appl. No.: 15/580,722

(22) PCT Filed: May 12, 2016

(86) PCT No.: PCT/EP2016/060647
§ 371 (c)(1),
(2) Date: Dec. 8, 2017

(87) PCT Pub. No.: WO2016/198231
PCT Pub. Date: Dec. 15, 2016

(65) Prior Publication Data

US 2018/0162427 A1 Jun. 14, 2018

(30) Foreign Application Priority Data

Jun. 8, 2015 (DE) ..... 10 2015 210 427

(51) Int. Cl.
*B61L 21/10* (2006.01)
*B61L 1/16* (2006.01)
(Continued)

(52) U.S. Cl.
CPC ..... *B61L 21/10* (2013.01); *B61L 1/161* (2013.01); *B61L 25/025* (2013.01);
(Continued)

(58) Field of Classification Search
CPC ..... B61L 1/161; B61L 21/10; B61L 25/025; B61L 25/026; B61L 27/0038; B61L 27/0066; B61L 2027/005
(Continued)

(56) References Cited

U.S. PATENT DOCUMENTS 9,561,813 B2 2/2017 Ohmstede
10,399,585 B2 * 9/2019 Ren ..... B61L 23/34
(Continued)

FOREIGN PATENT DOCUMENTS

CN 101934807 A 1/2011
CN 104684785 A 6/2015
(Continued)

OTHER PUBLICATIONS

Company Publication "Trainguard MT—Optimal performance with the world's leading automatic train control system for mass Transit" (Order No. A19100-V100-13976, Siemens AG 2014)—English Version; 2014.

*Primary Examiner* — Atul Trivedi
(74) *Attorney, Agent, or Firm* — Laurence Greenberg Werner Stemer; Ralph Locher

(57) ABSTRACT

A method and device for ascertaining movement authority for track-bound vehicles allow interference with a driving operation resulting in special operational situations or disturbances to be kept as low as possible. The position of the vehicle is determined and used to check whether the vehicle is located completely in an axle-counting section of an axle-counting system. The number of axles of the vehicle is compared with the number of axles located in the relevant
(Continued)

section according to the system. If the vehicle is located completely in the relevant section and the number of axles of the vehicle matches the number of axles located in the section according to the system, a movement authority is ascertained for the vehicle. The part of the relevant section in front of the vehicle in the driving direction is assumed to be free of other vehicles when ascertaining the movement authority.

14 Claims, 2 Drawing Sheets

(51) Int. Cl.
*B61L 25/02* (2006.01)
*B61L 27/00* (2006.01)

(52) U.S. Cl.
CPC ..... *B61L 25/026* (2013.01); *B61L 27/0038* (2013.01); *B61L 27/0066* (2013.01); *B61L 2027/005* (2013.01)

(58) Field of Classification Search
USPC ..... 701/19
See application file for complete search history.

(56) References Cited

U.S. PATENT DOCUMENTS

2007/0219681 A1* 9/2007 Kumar ..... B61L 27/0027 701/19
2009/0143928 A1* 6/2009 Ghaly ..... B61L 19/06 701/19
2012/0323411 A1* 12/2012 Whitwam ..... B61L 11/08 701/19
2013/0218375 A1* 8/2013 Ning ..... B61L 27/0038 701/19
2014/0277860 A1* 9/2014 Pulliam ..... B60L 1/003 701/19
2015/0014488 A1* 1/2015 Saito ..... B60L 3/0015 246/184
2015/0057845 A1* 2/2015 Fisher ..... G01F 15/075 701/19
2015/0088345 A1* 3/2015 Nandedkar ..... B61L 25/021 701/20
2015/0191186 A1* 7/2015 Lucisano ..... B61D 3/16 701/2
2015/0232110 A1* 8/2015 Ghaly ..... B61L 27/0038 246/62
2015/0307119 A1* 10/2015 Ghaly ..... B61L 25/06 246/122 R
2017/0113707 A1* 4/2017 Ghaly ..... B61L 3/16
2018/0339721 A1* 11/2018 Bresson ..... B61L 21/04
2019/0077432 A1* 3/2019 Itagaki ..... B61L 23/14
2019/0193764 A1* 6/2019 Cooper ..... B61L 17/00
2019/0248395 A1* 8/2019 Kutschera ..... B61L 27/0038

FOREIGN PATENT DOCUMENTS

DE 102004057907 A1 6/2006
DE 102012217591 A1 3/2014
DE 102012217595 A1 3/2014
EP 3028922 A1 6/2016
WO 2013156299 A2 10/2013

* cited by examiner

METHOD AND DEVICE FOR ASCERTAINING A MOVEMENT AUTHORITY FOR A TRACK-BOUND VEHICLE

BACKGROUND OF THE INVENTION

Field of the Invention

A method for ascertaining a movement authority for a track-bound vehicle, which can be, for example, a rail vehicle, a track-guided vehicle having rubber tires, or also a maglev train, is known, for example, from the company document "Trainguard MT—Optimal performance with the world's leading automatic train control system for mass transit" (order number: A19100-V100-B976-X-7600, Siemens AG 2014). This describes a CBTC (communications-based train control) system for automatically influencing track-bound vehicles in the form of underground railways or metros. In this case, network capacities and network throughputs are optimized in that by means of continuous bidirectional communication between the vehicles and the route, driving is enabled in moving spatial distance (moving block operation). This presumes that track-bound vehicles cyclically report the position thereof in operation to a route-side device of the train control system. Based on the reported positions, movement authorities are ascertained for the individual track-bound vehicles and transmitted to the respective vehicle. In this case, a corresponding movement authority, which is typically also referred to as a "movement authority", comprises at least one specification of up to which point the respective track-bound vehicle may move further.

SUMMARY OF THE INVENTION

The present invention is based on the object of specifying a method and a device for ascertaining a movement authority for a track-bound vehicle, which enable impairments of the driving operation resulting in case of operational special situations or malfunctions to be reduced or kept as minor as possible.

This object is achieved according to the invention by a method for ascertaining a movement authority for a track-bound vehicle, which travels on a route divided by means of an axle-counting system into axle-counting sections, wherein the position of the track-bound vehicle is determined, it is checked on the basis of the determined position whether the track-bound vehicle is completely located in one of the axle-counting sections, the number of the axles of the track-bound vehicle is compared to the number of the axles located in the relevant axle-counting section according to the axle-counting system, and if the track-bound vehicle is completely located in the relevant axle-counting section and the number of the axles of the track-bound vehicle corresponds to the number of the axles located in this axle-counting section according to the axle-counting system, a movement authority is ascertained for the track-bound vehicle, wherein during the ascertainment of the movement authority, the part of the relevant axle-counting section located in front of the track-bound vehicle in the travel direction is assumed to be free of other track-bound vehicles.

The method according to the invention for ascertaining a movement authority for a track-bound vehicle is therefore usable in those cases in which the track-bound vehicle or multiple track-bound vehicles travels or travel, respectively, on a route divided by means of an axle-counting system into axle-counting sections. In this case, the method according to the invention advantageously makes use of the fact that train control systems, for example, in the form of CBTC systems, frequently have a track vacancy report system, which is not used in normal operation, as a fallback level.

In the event of complete or partial failure of the train control system, this track vacancy report system is used for an emergency or malfunction operation, wherein in this case the performance capacity of the system is greatly restricted since, for example, moving block operation is no longer possible.

According to the first step of the method according to the invention, the position of the track-bound vehicle is determined. In the next step, it is checked on the basis of the determined position whether the track-bound vehicle is located completely in one of the axle-counting sections. In the following method step, which can in principle also be carried out partially or completely at the same time with the two preceding method steps or optionally also partially or completely already before them, the number of the axles of the track-bound vehicle is compared to the number of the axles located in the relevant axle-counting section according to the axle-counting system. If the track-bound vehicle is located completely in the relevant axle-counting section and the number of the axles of the track-bound vehicle corresponds to the number of the axles located in this axle-counting section according to the axle-counting system, it is ensured that no other track-bound vehicle, which is not emitting position reports, is located in the relevant axle-counting section. In this way, ascertaining a movement authority for the track-bound vehicle is therefore enabled, wherein during the ascertainment of this movement authority, the part of the relevant axle-counting section located in front of the track-bound vehicle in the travel direction is assumed to be free of other track-bound vehicles. This means that the ascertained movement authority with respect to the occupancy status of the relevant axle-counting section can extend at least up to the following axle-counting section in the travel direction.

The method according to the invention is advantageous because in case of operational malfunctions or special situations, it reduces the restrictions resulting in this way for the driving operation of the track-bound vehicle or the track-bound vehicles. This relates in particular to those operational situations in which a statement as to whether another track-bound vehicle is possibly stopped in addition to the track-bound vehicle in the relevant axle-counting section is initially not possible. These are those cases in which it cannot be completely precluded that in addition to track-bound vehicles reporting the position thereof, other vehicles, for example, in the form of special vehicles, are also stopped on the route and/or specifically in the respective axle-counting section. In addition, in case of a temporary communication failure between at least one track-bound vehicle operated on the route and a route-side control device, the situation can also occur that it cannot be ensured with 100% certainty that another track-bound vehicle is stopped in front of the track-bound vehicle. This also applies to the case in which the track-bound vehicle or a further one of the track-bound vehicles operated on the route has first begun its operation, and therefore sufficient items of information are not yet available to preclude an "undiscovered" other vehicle. It is to be taken into consideration in this case that the respective axle-counting section is occupied by the track-bound vehicle itself and the occupancy information output by the track vacancy report system in the form of the axle-counting system thus does not permit a statement per se as to whether, in addition to the track-bound vehicle, possibly another vehicle which is not emitting position reports is entirely or partially stopped in the relevant axle-counting section.

The method according to the invention advantageously combines an item of information on the number of the axles of the track-bound vehicle with the number of the axles located in the relevant axle-counting section according to the axle-counting system. If the corresponding numbers of axles do not correspond, this is thus a clear indication that a further track-bound vehicle is stopped in the relevant axle-counting section. However, if the number of the axles of the track-bound vehicle corresponds to the number of the axles located in this axle-counting section according to the axle-counting system, and simultaneously the track-bound vehicle is located completely in the relevant axle-counting section, it is thus proven that no other track-bound vehicle is stopped in the relevant axle-counting section. This is the condition for a movement authority being ascertained for the track-bound vehicle, wherein during the ascertainment of this movement authority, the part of the relevant axle-counting section located in front of the track-bound vehicle in the travel direction is assumed to be free of other track-bound vehicles. Because a corresponding movement authority can be ascertained, severe operational disturbances are advantageously avoided, which could otherwise arise depending on the respective circumstances. This is because if it cannot be precluded that another track-bound vehicle is located in the axle-counting section in front of the track-bound vehicle in the travel direction, the track-bound vehicle can thus move forward at most at a velocity which, in case of a further track-bound vehicle appearing in front of the track-bound vehicle, enables reliable braking of the track-bound vehicle at any time, to avoid a collision. By way of the method according to the invention, in many situations the necessity of a corresponding restricted operation of the track-bound vehicle is omitted, i.e., a moving block operation can be maintained or assumed (again) as early as possible. As a result, the robustness and the reliability of the driving operation are increased in this way.

It is to be noted that an axle-counting section in the meaning of the present application can also be a combined "logical" axle-counting section composed of multiple adjoining axle-counting sections. In this case, which presumes a corresponding synchronization of the axle counters of the axle-counting section, two or more adjacent axle-counting sections are therefore combined into one logical axle-counting section in the observation. If the track-bound vehicle is located completely in the logical axle-counting section defined in this manner, and the number of the axles of the track-bound vehicle corresponds to the number of the axles located in this logical axle-counting section according to the axle-counting system, a movement authority can thus also be ascertained for the track-bound vehicle in this case, wherein during the ascertainment of the movement authority, the part of the relevant logical axle-counting section located in front of the track-bound vehicle in the travel direction is again assumed to be free of other track-bound vehicles.

According to one particularly preferred embodiment of the method according to the invention, during the ascertainment of the movement authority, at least one further track-bound vehicle is taken into consideration, which is located at least partially in the relevant track section. In this case, the at least one further track-bound vehicle taken into consideration is such a track-bound vehicle, the position of which is known, i.e., in particular is not another vehicle which is "unknown" to the system, and which is not emitting position reports.

According to a further particularly preferred refinement of the method according to the invention, the at least one further track-bound vehicle is taken into consideration in such a way that the movement authority is only ascertained for the track-bound vehicle if the at least one further track-bound vehicle is also completely located in the relevant axle-counting section. This is advantageous because the number of the axles located in the relevant axle-counting section according to the axle-counting system can only be compared reliably and robustly to the number of the axles of the track-bound vehicles if both the track-bound vehicle and also the at least one further track-bound vehicle are located completely in the relevant axle-counting section. Similarly to the above statements in this regard, the axle-counting section can in this case again also be a logical axle-counting section formed from multiple adjacent axle-counting sections.

The method according to the invention can preferably also be refined such that the at least one further track-bound vehicle is taken into consideration such that the total of the number of the axles of the track-bound vehicle and the at least one further track-bound vehicle is compared to the number of the axles located in this axle-counting section according to the axle-counting system and the movement authority is ascertained for the track-bound vehicle if the at least one further track-bound vehicle is located behind the track-bound vehicle viewed in the travel direction thereof. This means that even for the case in which at least one further track-bound vehicle is stopped in the relevant axle-counting section in addition to the track-bound vehicle, a statement is possible as to whether another track-bound vehicle, which does not emit position reports and is "non-reporting," is located in front of the track-bound vehicle. Thus, for the case in which the total of the number of the axles of the track-bound vehicle and of the at least one further track-bound vehicle corresponds to the number of the axles located in the relevant axle-counting section according to the axle-counting system, it is proven that exclusively the track-bound vehicle and the at least one further track-bound vehicle are located in the axle-counting section. If the at least one further track-bound vehicle is located behind the track-bound vehicle viewed in the travel direction thereof, the movement authority can therefore be ascertained for the track-bound vehicle, wherein the part of the relevant axle-counting section located in front of the track-bound vehicle in the travel direction is also assumed to be free of other track-bound vehicles in this case during the ascertainment of the movement authority. As a result, for example, even in the case of comparatively long axle-counting sections, in which multiple track-bound vehicles can stop simultaneously, a statement can therefore be made on the basis of a comparison of the number of the axles of the known track-bound vehicles located in the axle-counting section to the number of the axles located in this axle-counting section according to the axle-counting system as to whether the region of the route between the track-bound vehicle and the boundary of the axle-counting section located in the travel direction is free of other track-bound vehicles or not.

According to a further particularly preferred embodiment of the method according to the invention, during the ascertainment of the movement authority for the track-bound vehicle, items of information on the position of other track-bound vehicles on the route and/or on the occupancy of other axle-counting sections of the route are taken into consideration. This can be performed, for example, in such a way that for the case in which an axle-counting section following in the travel direction is free, the movement authority also entirely or partially relates to this following axle section, such that the movement authority extends up into this axle-counting section or to the end thereof, respectively. The situation in which the axle-counting section following in the travel direction is occupied by another track-bound vehicle can also be handled in a similar manner, but it is ensured, for example, on the basis of a comparison of the number of axles of the further track-bound vehicle to the number of axles located in the following axle-counting section according to the axle-counting system that exclusively the other track-bound vehicle is stopped in this axle-counting section. A movement authority can thus also be ascertained for the track-bound vehicle in this case, which extends up to the known position of the other track-bound vehicle in the following axle-counting section.

The method according to the invention is advantageously designed such that the movement authority for the track-bound vehicle is ascertained by a stationary control device of a train control system. A corresponding stationary control device of a track influencing system can in this case be a component arranged on the route, on the one hand. On the other hand, it is also possible that the movement authority for the track-bound vehicle is ascertained by a stationary control device in the form of a central control device of a train control system, wherein the communication with the track-bound vehicles traveling on the route can optionally be performed with components arranged on the route being interconnected.

In the scope of the method according to the invention, the position of the track-bound vehicle can in principle be ascertained in an arbitrary manner which is known per se. It is considered to be particularly advantageous if the position of the track-bound vehicle is determined on the vehicle side and transmitted to the stationary control device and it is ascertained by the stationary control device on the basis of the transmitted position whether the track-bound vehicle is completely located in one of the axle-counting sections. Thus, in known methods for automatically influencing track-bound vehicles, a vehicle-side position determination of the respective track-bound vehicle is typically performed. This can be performed, for example, using an odometer, for example, in the form of a distance pulse encoder and/or a radar measuring unit, optionally additionally using route-side beacons as reference points. Thus, CBTC systems typically transmit the correspondingly ascertained position thereof to a stationary control device of the CBTC system. At the same time, its integrity is to be ensured and/or monitored on the part of the respective track-bound vehicle. A transmission of an item of information to the stationary control device as to whether the integrity of the respective track-bound vehicle is ensured can be performed, for example, such that a valid position is only transmitted to the stationary control device on the part of a track-bound vehicle if the integrity of the track-bound vehicle can be ensured by the vehicle itself. On the basis of the transmitted (valid) position of the track-bound vehicle, it is possible for the stationary control device to ascertain whether the track-bound vehicle is completely located in one of the axle-counting sections. Supplements are preferably taken into consideration in this case, which can take into account, for example, inaccuracies of the position determination and/or buffer surpluses.

According to a further particularly preferred refinement of the method according to the invention, the number of its axles is transmitted by the track-bound vehicle to the stationary control device and the number of the axles of the track-bound vehicle is compared by the stationary control device to the number of the axles located in the relevant axle-counting section according to the axle-counting system. This is advantageous because the number of its axles is typically known to the track-bound vehicle. This is true in particular in the case of track-bound vehicles in the form of underground railways or metros, which typically travel in fixed configurations. The number of the axles of the track-bound vehicle can therefore be known thereto, for example, as a configuration parameter, which can be permanently specified or ascertained, for example, in the scope of the startup of the track-bound vehicle or can be input by an operator. On the basis of the number of the axles of the track-bound vehicle transmitted by the track-bound vehicle to the stationary control device, it is possible for the stationary control device to compare the number of the axles of the track-bound vehicle to the number of the axles located in the relevant axle-counting section according to the axle-counting system. This means that an item of information on the number of the axles located in the relevant axle-counting section is transmitted to the stationary control device on the part of the axle-counting system or the stationary control device in turn has access to the corresponding information of the axle-counting system.

According to a further advantageous embodiment of the method according to the invention, the movement authority is transmitted by the stationary control device to the track-bound vehicle. This is advantageous because it is thus made possible for the track-bound vehicle to carry out its further driving operation on the basis of the received movement authority.

The method according to the invention can preferably also be embodied such that the track-bound vehicle is operated in a CBTC (communications-based train control) system. Because of the architecture thereof, CBTC systems typically enable an implementation of the method according to the invention with comparatively low expenditure.

The object on which the invention is based is furthermore achieved by a device for ascertaining a movement authority for a track-bound vehicle, which travels on a route divided by means of an axle-counting system into axle-counting sections, wherein the device is designed to determine the position of the track-bound vehicle, to check on the basis of the determined position whether the track-bound vehicle is completely located in one of the axle-counting sections, to compare the number of the axles of the track-bound vehicle to the number of the axles located in the relevant axle-counting section according to the axle-counting system, and to ascertain a movement authority for the track-bound vehicle if the track-bound vehicle is completely located in the relevant axle-counting section and the number of the axles of the track-bound vehicle corresponds to the number of the axles located in this axle-counting section according to the axle-counting system, wherein the device, during the ascertainment of the movement authority assumes the part of the relevant axle-counting section located in front of the track-bound vehicle in the travel direction to be free of other track-bound vehicles.

The advantages of the device according to the invention correspond to those of the method according to the invention, so that reference is made in this regard to the corresponding statements above. This also applies with respect to the preferred refinements of the device according to the invention mentioned hereafter, so that reference is also made in this regard to the corresponding explanations above.

According to one particularly preferred refinement, the device according to the invention comprises at least one vehicle device arranged on the track-bound vehicle and also at least one stationary control device of a train control system.

According to a further particularly preferred embodiment, the device according to the invention is designed for carrying out one of the above-mentioned preferred refinements of the method according to the invention.

According to a further particularly preferred embodiment, the device according to the invention is designed as a component of a CBTC (communications-based train control) system.

BRIEF DESCRIPTION OF THE SEVERAL VIEWS OF THE DRAWING

The invention will be explained in greater detail hereafter on the basis of exemplary embodiments. In the figures

DESCRIPTION OF THE INVENTION

For reasons of clarity, identical components are identified with identical reference signs in the figures.

Figure 1:
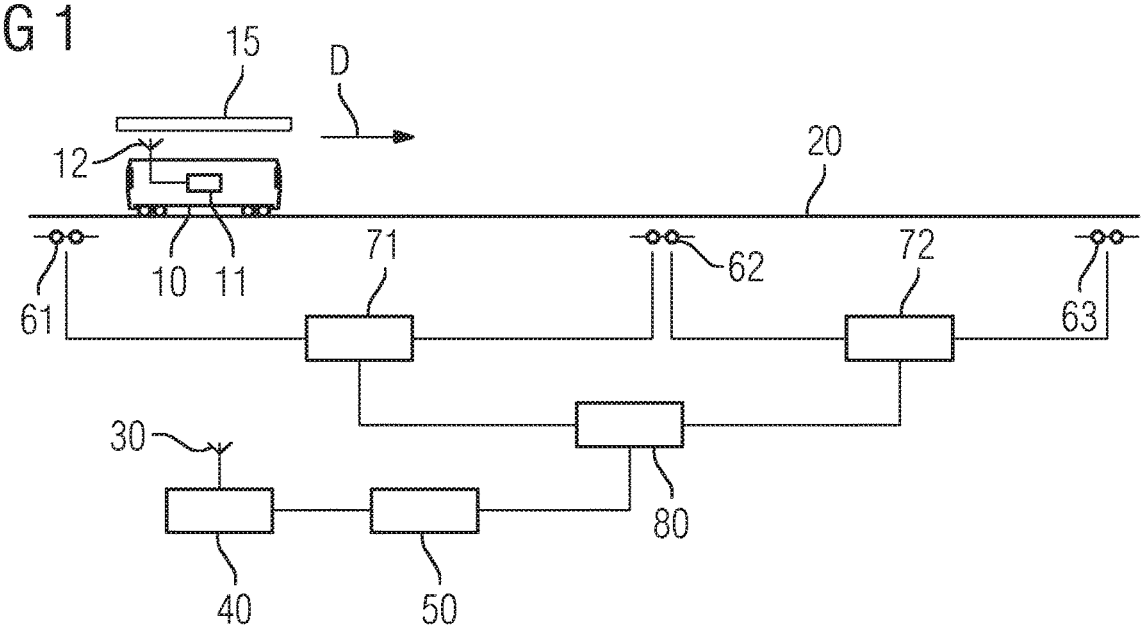
FIG. 1 shows an arrangement having an exemplary embodiment of the device according to the invention in a situation in which a track-bound vehicle is located completely in an axle-counting section to explain an exemplary embodiment of the method according to the invention in a first schematic sketch.

FIG. 1 shows an arrangement having an exemplary embodiment of the device according to the invention in a situation in which a track-bound vehicle 10 is located completely in an axle-counting section to explain an exemplary embodiment of the method according to the invention in a first schematic sketch. The track-bound vehicle 10 has a vehicle device 11, which is connected via a communication connection to a vehicle-side transmission device 12. By means of the vehicle-side transmission device 12 it is possible for the track-bound vehicle 10 or its vehicle device 11, respectively, to transmit a position 15 of the track-bound vehicle 10 to a route-side transmission device 30. The route-side transmission device 30 has a communication connection to a route-side device 40, which in turn has a communication connection to a stationary control device 50 of a train control system.

It is to be noted that the route-side transmission device 30, the route-side device 40, and the stationary control device 50, notwithstanding the illustration of FIG. 1, could also be partially or entirely embodied as a common component or multiple common components.

It is assumed in the scope of the described exemplary embodiment that the track-bound vehicle 10 moves in a travel direction D along a route 20, which can be, for example, a railway route for an underground railway or metro. Furthermore, it is assumed that the track-bound vehicle 10 is operated in a train control system in the form of a CBTC (communications-based train control) system. In this case, the track-bound vehicle 10 reports its position by means of the vehicle-side transmission device 12 to the route-side transmission device 30 in a normal operation of the CBTC system, which corresponds to a moving block operation. The corresponding position 15, which is ascertained on the part of the track-bound vehicle 10 and transmitted to the route-side transmission device 30, and which explicitly or implicitly comprises a specification of the position of the front end and a specification of the position of the rear end of the track-bound vehicle 10, is indicated in FIG. 1 by a corresponding "position strip", which preferably takes into consideration the accuracy of the vehicle-side position determination and optionally further aspects, for example, buffer surpluses. The position 15 is ascertained by the vehicle device 11 and/or one component connected thereto or multiple components connected thereto. This can be performed, for example, using at least one distance pulse encoder, at least one radar measuring device, at least one GNSS (global navigation satellite system) receiver, and/or other components known per se, optionally with incorporation of route-side components, for example, in the form of beacons.

Based on the position 15 reported by the track-bound vehicle 10 and corresponding positions of other track-bound vehicles possibly traveling on the route 20, a movement authority for the track-bound vehicle 10 is ascertained on the part of the stationary control device 50 and transmitted via the route-side transmission device 30 to the vehicle-side transmission device 12 and from there to the vehicle device 11. In normal operation, it is therefore communicated to the track-bound vehicle 10 where the next hazard point is located, i.e., up to which point of the route 20 it can continue its travel without hazard.

In practice, the situation can now occur that in special situations or in the event of a disturbance of the operation, no reliable statement is possible to the CBTC system as to whether another track-bound vehicle is possibly located on the route 20, which is not emitting position reports and therefore could endanger the operation of the track-bound vehicle 10. A corresponding situation can occur, for example, if the track-bound vehicle 10 begins its driving operation and the CBTC system as a whole does not yet have any items of information which are sufficient to preclude the existence of other "non-reporting" track-bound vehicles on the route 20. Furthermore, a situation of the mentioned type can also occur, for example, if failures or disturbances occur in the communication between the track-bound vehicles operated in the CBTC system and the route-side device 40 and/or corresponding route-side devices.

CBTC systems frequently have a track vacancy report system as a fallback level, the items of information of which are typically not used in normal operation. A corresponding track vacancy report system in the form of an axle-counting system is indicated in FIG. 1 by means of wheel sensors or axle-counting sensors 61, 62, 63 and axle-counting analysis devices 71 and 72. The axle-counting analysis devices 71 and 72 have communication connections, on the one hand, to the wheel sensors 61, 62, 63 and, on the other hand, to a positioning mechanism 80. Two axle-counting sections are formed by the wheel sensors 61, 62, and 63, wherein the track-bound vehicle 10 is located in the exemplary embodiment of FIG. 1 in the left axle-counting section, which is to the rear viewed in the travel direction D, and which is formed by the wheel sensors 61 and 62.

In the above-mentioned operational special and/or malfunction situations, the vacancy report information of the axle-counting system also does not permit any statement, however, as to whether another track-bound vehicle is possibly stopped in the axle-counting section delimited by the wheel sensors 61 and 62 in front of the track-bound vehicle 10 viewed in the travel direction D. The relevant axle-counting section is thus already reported as occupied on the part of the axle-counting system because of the fact that the track-bound vehicle 10 is located in this axle-counting section. However, it cannot be concluded therefrom that another vehicle, for example, in the form of a special vehicle or a track-bound vehicle having malfunctioning communication, is not additionally stopped in the relevant axle-counting section, in particular in the region between the front end of the track-bound vehicle 10 and the wheel sensor 62.

To now substantially avoid impairments of the driving operation even in such a situation, the device shown in FIG. 1 can advantageously be operated as follows according to one exemplary embodiment of the method according to the invention:

It is checked on the part of the stationary control device 50, on the basis of the position of the track-bound vehicle 10, which is determined by the track-bound vehicle 10 and/or its vehicle device 11 and transmitted by means of the vehicle-side transmission device 12 and the route-side device 30 and the route device 40 to the stationary control device 50, whether the track-bound vehicle 10 is completely located in one of the axle-counting sections. According to the illustration of FIG. 1, this is the case according to the reported position 15 in the exemplary embodiment shown, i.e., the track-bound vehicle 10 is located completely in the axle-counting section formed and/or delimited by the wheel sensors 61 and 62.

In the scope of the described exemplary embodiment of the method according to the invention, the track-bound vehicle 10 transmits, together with its position 15, the number of its axles to the stationary control device 50. In this way, it is made possible for the stationary control device 50 to compare the received number of the axles of the track-bound vehicle 10 to the number of the axles located in the relevant axle section according to the axle-counting system. For this purpose, the stationary control device 50 furthermore also has a communication connection to the positioning mechanism 80, so that the number of the axles located in the relevant axle-counting section according to the axle-counting system is provided to the stationary control device 50 and/or the stationary control device 50 can access this information.

In the exemplary embodiment shown in FIG. 1, the track-bound vehicle 10 has four axles. It is assumed that four axles are also stopped in the axle-counting section formed by the two wheel sensors 61 and 62 according to the axle-counting system. Because the track-bound vehicle 10 is completely located in the relevant axle-counting section and the number of the axles of the track-bound vehicle 10 also corresponds to the number of the axles located in this axle-counting section according to the axle-counting system, the stationary control device 50 now ascertains a movement authority for the track-bound vehicle 10, wherein during the ascertainment of the movement authority, the part of the relevant axle-counting section located in front of the track-bound vehicle 10 in the travel direction D, i.e., the region between the front end of the track-bound vehicle 10 and the wheel sensor 61, is assumed to be free of other track-bound vehicles.

The movement authority ascertained under the above-mentioned assumption, which has been confirmed by the comparison of the numbers of axles, is thereupon transmitted from the stationary control device 50 via the route-side device 40 and the route-side transmission device 30 to the vehicle-side transmission device 12, which relays the movement authority to the vehicle device 11. It is therefore possible for the track-bound vehicle 10 or the vehicle device 11 thereof, based on the received movement authority, to begin or continue automatic CBTC operation. In the exemplary embodiment shown in FIG. 1, the movement authority ascertained on the part of the stationary control device 50 can additionally take into consideration in this case that according to the axle-counting system, i.e., the vacancy report information provided by the axle-counting analysis device 72, the axle-counting section following in the travel direction D, which is formed by the wheel sensors 62 and 63, is free of any track-bound vehicles. Depending on the embodiment of the respective CBTC system and the vacancy report state of further axle-counting sections and also reported positions of other track-bound vehicles on the route 20, the movement authority for the track-bound vehicle 10 can therefore extend up to the wheel sensor 62, up to the wheel sensor 63, up to a point located between these two, or also a point located still further in the travel direction.

It is to be noted that the embodiment of the device according to the invention shown in FIG. 1, which comprises in particular the vehicle device 11 and the stationary control device 50, will generally have both hardware components, for example, in the form of at least one processor and at least one storage unit, and also software components, for example, in the form of control programs.

Figure 2:
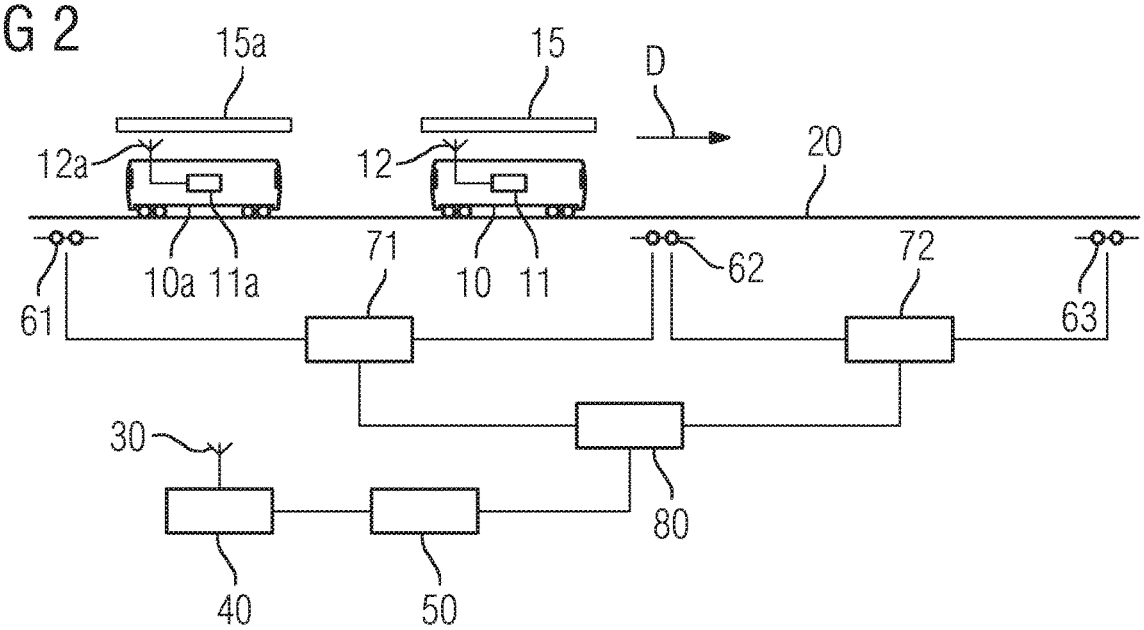
FIG. 2 shows the arrangement having the exemplary embodiment of the device according to the invention in a situation in which the track-bound vehicle and a further track-bound vehicle are located completely in the axle-counting section to further explain the exemplary embodiment of the method according to the invention in a second schematic sketch.

FIG. 2 shows the arrangement having the exemplary embodiment of the device according to the invention in a situation in which the track-bound vehicle and a further track-bound vehicle are located completely in the axle-counting section for further explanation of the exemplary embodiment of the method according to the invention in a second schematic sketch.

The illustration in FIG. 2 corresponds in large parts to that of FIG. 1. However, in contrast to FIG. 1, a situation is shown in FIG. 2 in which a further track-bound vehicle 10*a* is located behind the track-bound vehicle 10 viewed in the travel direction D, which, similarly to the track-bound vehicle 10, has a vehicle device 11*a* and a vehicle-side transmission device 12*a*. The position 15*a*, which is ascertained on the part of the further track-bound vehicle 10*a* and is transmitted by means of the vehicle-side transmission device 12*a* via the route-side transmission device 30 and the route-side device 40 to the stationary control device 50, is indicated in FIG. 2 by a corresponding position strip, similarly to the position 15 of the track-bound vehicle 10.

According to the illustration of FIG. 2, the position 15*a* of the further track-bound vehicle 10*a* is also located completely in the axle-counting section delimited by the wheel sensors 61 and 62. In this way, it is advantageously made possible for the further track-bound vehicle 10*a* to be taken into consideration such that the total of the number of the axles of the track-bound vehicle 10 and the further track-bound vehicle 10*a* is compared to the number of the axles located in the relevant axle-counting section according to the axle-counting system. According to the schematic illustration of FIG. 2, both the track-bound vehicle 10 and also the further track-bound vehicle 10*a* each have four axles. If the total of the axles, which is eight in the present case, corresponds to the number of the axles located in the axle-counting section according to the axle-counting system, it is in turn proven that no other track-bound vehicle is located in the axle-counting section delimited by the wheel sensors 61 and 62 in front of the track-bound vehicle 10 viewed in the travel direction D. Presuming that the further track-bound vehicle 10*a* is located behind the track-bound vehicle 10 viewed in the travel direction of the track-bound vehicle 10, it is therefore also possible in the situation shown in FIG. 2 to ascertain a movement authority for the track-bound vehicle 10, wherein during the ascertainment of the movement authority, the part of the relevant axle-counting section located in front of the track-bound vehicle 10 in the travel direction D is again assumed to be free of other track-bound vehicles.

The consideration of the further track-bound vehicle 10*a* according to the procedure described above is advantageous because in this way, for example, even in the case of comparatively longer axle-counting sections, in which multiple track-bound vehicles 10, 10*a* are stopped, a movement authority can be ascertained for the track-bound vehicle 10 and transmitted thereto. In a corresponding way, a third or even a fourth track-bound vehicle, which follows the track-bound vehicle 10 and is located in the same axle-counting section, could also be taken into consideration.

Figure 3:
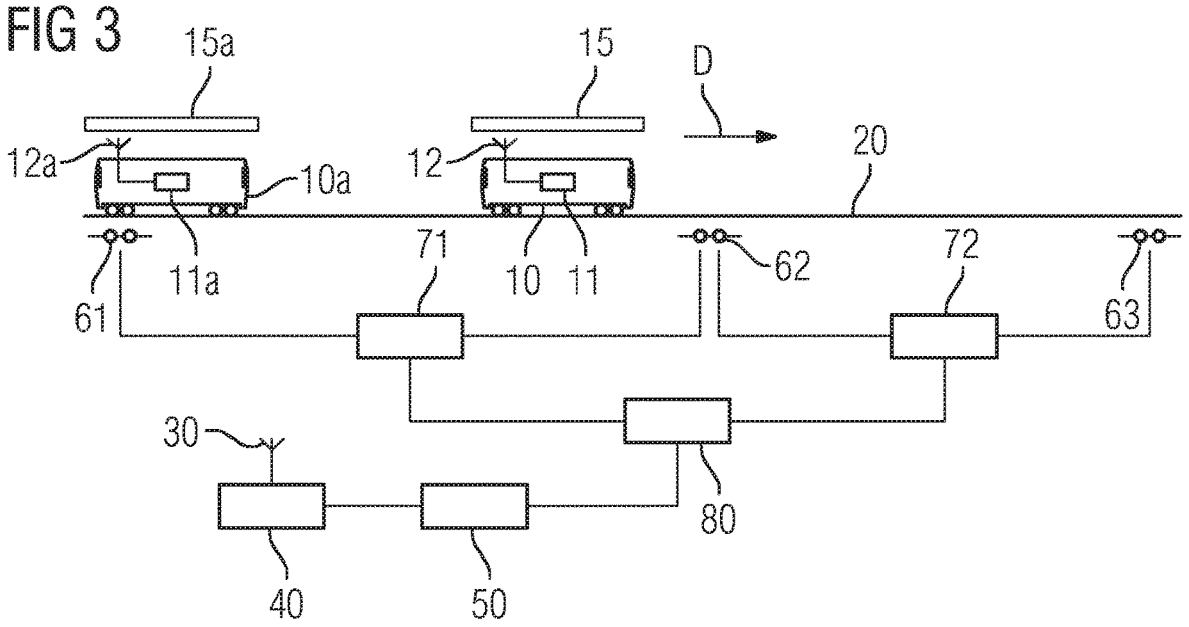
FIG. 3 shows the arrangement having the exemplary embodiment of the device according to the invention in a situation in which the track-bound vehicle is located completely in the axle-counting section, but the further track-bound vehicle is only incompletely located in this section, to further explain the exemplary embodiment of the method according to the invention in a third schematic sketch.

FIG. 3 shows the arrangement having the exemplary embodiment of the device according to the invention in a situation in which the track-bound vehicle is located completely in the axle-counting section, but the further track-bound vehicle is only located incompletely, to further explain the exemplary embodiment of the method according to the invention in a third schematic sketch.

The situation shown in FIG. 3 substantially corresponds to that of FIG. 2. In the fundamental contrast thereto, in the situation shown in FIG. 3, however, the further track-bound vehicle 10*a* is not located completely in the axle-counting section delimited by the wheel sensors 61, 62. This is clear by way of the indicated position strip 15*a* in relation to the position of the wheel sensor 61. In this situation, it cannot be reliably precluded by a comparison of the total of the number of the axles of the track-bound vehicle 10 and the further track-bound vehicle 10*a* to the number of the axles located in the relevant axle-counting section according to the axle-counting system that another track-bound vehicle is possibly also still entirely or partially stopped in the relevant axle-counting section in front of the track-bound vehicle 10 viewed in the travel direction D. The further track-bound vehicle 10*a* is therefore taken into consideration in the situation shown in FIG. 3 such that a movement authority is not ascertained for the track-bound vehicle 10. The cause of this is therefore that the further track-bound vehicle 10*a* is not completely located in the relevant axle-counting section.

According to the above explanations in conjunction with the described exemplary embodiments of the method according to the invention and the device according to the invention, these enable, by way of a combination of the positions 15, 15*a* of the vehicles 10, 10*a* and the number of axles thereof with the number of the axles located in the relevant axle-counting section according to the axle-counting system, moving block operation in a CBTC system even in certain malfunction situations or, in the case of beginning operation by one of the track-bound vehicles or by the overall system, a movement authority to be ascertained for the track-bound vehicle 10. In this way, impairments of the operation of the track-bound vehicle 10 and/or the overall system can advantageously be avoided or at least substantially reduced, so that an increase of the robustness results with respect to the overall system.

The invention claimed is:

1. A method for ascertaining a movement authority for a track-bound vehicle traveling in a travel direction on a route divided into axle-counting sections by an axle-counting system, the method comprising the following steps:

determining a position of the track-bound vehicle;

using the determined position to check whether the track-bound vehicle is completely located in one of the axle-counting sections;

comparing a number of axles of the track-bound vehicle to a number of axles located in a relevant axle-counting section according to the axle-counting system;

ascertaining a movement authority for the track-bound vehicle if the track-bound vehicle is completely located in the relevant axle-counting section and the number of the axles of the track-bound vehicle corresponds to the number of the axles located in the axle-counting section according to the axle-counting system; and during the ascertainment of the movement authority, assuming a part of the relevant axle-counting section located in front of the track-bound vehicle in the travel direction to be free of other track-bound vehicles.

2. The method according to claim 1, which further comprises taking at least one further track-bound vehicle located at least partially in the relevant track section into consideration during the ascertainment of the movement authority.

3. The method according to claim 2, which further comprises taking the at least one further track-bound vehicle into consideration by only ascertaining the movement authority for the track-bound vehicle if the at least one further track-bound vehicle is also completely located in the relevant axle-counting section.

4. The method according to claim 2, which further comprises:

taking the at least one further track-bound vehicle into consideration by comparing a total of the number of the axles of the track-bound vehicle and the at least one further track-bound vehicle to the number of the axles located in the axle-counting section according to the axle-counting system; and ascertaining the movement authority for the track-bound vehicle if the at least one further track-bound vehicle is located behind the track-bound vehicle in the travel direction.

5. The method according to claim 1, which further comprises taking items of information regarding at least one of a position of other track-bound vehicles on the route or an occupancy of other axle-counting sections of the route into consideration during the ascertainment of the movement authority for the track-bound vehicle.

6. The method according to claim 1, which further comprises using a stationary control device of a train control system to ascertain the movement authority for the track-bound vehicle.

7. The method according to claim 6, which further comprises:

determining the position of the track-bound vehicle at the vehicle and transmitting the position of the track-bound vehicle to the stationary control device; and using the stationary control device to ascertain whether the track-bound vehicle is completely located in one of the axle-counting sections based on the transmitted position.

8. The method according to claim 6, which further comprises:

transmitting the number of axles of the track-bound vehicle from the track-bound vehicle to the stationary control device; and using the stationary control device to compare the number of the axles of the track-bound vehicle to the number of the axles located in the relevant axle section according to the axle-counting system.

9. The method according to claim 6, which further comprises transmitting the movement authority from the stationary control device to the track-bound vehicle.

10. The method according to claim 1, which further comprises operating the track-bound vehicle in a CBTC system.

11. A device for ascertaining a movement authority for a track-bound vehicle traveling in a travel direction on a route divided into axle-counting sections by an axle-counting system, the device being configured:

to determine a position of the track-bound vehicle;

to check whether the track-bound vehicle is completely located in one of the axle-counting sections based on the determined position;

to compare a number of axles of the track-bound vehicle to a number of axles located in a relevant axle-counting section according to the axle-counting system;

to ascertain a movement authority for the track-bound vehicle if the track-bound vehicle is completely located in the relevant axle-counting section and the number of the axles of the track-bound vehicle corresponds to the number of the axles located in the axle-counting section according to the axle-counting system; and to assume a part of the relevant axle-counting section located in front of the track-bound vehicle in the travel direction to be free of other track-bound vehicles during the ascertainment of the movement authority.

12. The device according to claim 11, which further comprises at least one vehicle device disposed on the track-bound vehicle and at least one stationary control device of a train control system.

13. The device according to claim 12, wherein the at least one stationary control device of the train control system ascertains the movement authority for the track-bound vehicle.

14. The device according to claim 11, wherein the device is a component of a CBTC system.

* * * * *